United States Patent [19]

Yamaguchi et al.

[11] Patent Number: 4,822,672

[45] Date of Patent: Apr. 18, 1989

[54] ABASIVE TAPE

[75] Inventors: Nobutaka Yamaguchi; Eiichi Tadokoro; Takahito Miyoshi, all of Kanagawa, Japan

[73] Assignee: Fuji Photo Film Co., Ltd., Kanagawa, Japan

[21] Appl. No.: 20,842

[22] Filed: Feb. 27, 1987

[30] Foreign Application Priority Data

Feb. 27, 1986 [JP] Japan ..... 61-42742

[51] Int. Cl.[4] ..... B32B 5/16

[52] U.S. Cl. ..... 428/323; 428/329; 428/900; 428/689

[58] Field of Search ..... 428/900, 694, 329, 687, 428/323; 427/130

[56] References Cited

U.S. PATENT DOCUMENTS

| | | | |
|---|---|---|---|
| 4,047,232 | 9/1977 | Hisagen | 428/900 |
| 4,275,108 | 6/1981 | Yamaguchi | 428/425.9 |
| 4,379,800 | 4/1983 | Sato | 428/900 |
| 4,397,911 | 8/1983 | Akashi | 428/323 |
| 4,532,172 | 7/1985 | Fujiyama | 428/900 |
| 4,613,545 | 9/1986 | Chubachi | 428/900 |
| 4,701,364 | 10/1987 | Miyoshi | 428/694 |

*Primary Examiner*—Paul J. Thibodeau

*Attorney, Agent, or Firm*—Sughrue, Mion, Zinn, Macpeak & Seas

[57] ABSTRACT

An abrasive tape comprises a flexible non-magnetic substrate, and an abrasive coating film applied onto the flexible non-magnetic substrate and formed by kneading abrasive grains, a binder and an additive. The binder contains a resin which has, at a side chain, at least one polar group selected from the group consisting of $$-SO_3M,\ -OSO_3M,\ -OSO_2M,\ -COOM,\ \text{and} -\underset{\underset{O}{\|}}{\overset{\overset{(OM_2)}{|}}{P}}-(OM_1)$$

where M represents a hydrogen atom, lithium, sodium, or potassium, $M_1$ represents a hydrogen atom, lithium, sodium, potassium, or an alkyl group, and $M_2$ represents a hydrogen atom, lithium, sodium, potassium, or an alkyl group.

6 Claims, 1 Drawing Sheet

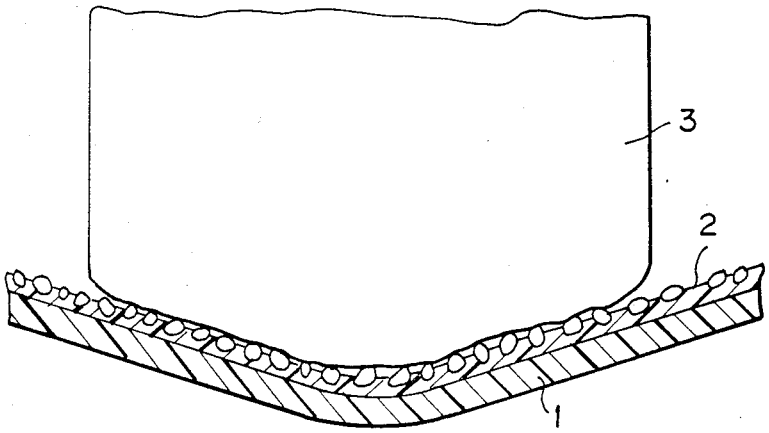
3
2
1

ABASIVE TAPE

BACKGROUND OF THE INVENTION

1. Field of the Invention

This invention relates to an abrasive tape for use in polishing of a magnetic head for a magnetic recording and reproducing apparatus. This invention particularly relates to an abrasive tape for use in polishing of a magnetic head mainly by being moved between two reels in the manner of an ordinary magnetic tape.

2. Description of the Prior Art

Video or high grade audio magnetic heads are required to have very smooth tape sliding surfaces. Therefore, in general, in the process of making the magnetic head, the magnetic head is disposed at a predetermined position after being rough ground, and the tape sliding surface of the magnetic head is polished to a smooth finish by moving an abrasive tape between two reels disposed with the magnetic head intervening therebetween. The abrasive tape comprises a flexible non-magnetic substrate, and a coating film formed of fine abrasive grains, a binder, and an additive such as a lubricant and applied onto the non-magnetic substrate.

As the abrasive tape, there has heretofore been known, for exmaple, a cleaning tape as disclosed in Japanese Unexamined Patent Publication No. 53(1978)-102017, which comprises a substrate, and a coating film overlaid on the substrate and formed of abrasive grains consisting of zinc oxide (ZnO) or the like, a binder consisting of a vinyl chloride-vinyl acetate copolymer, a polyester polyol or the like, a curing agent consisting of a polyisocyanate or the like, and an additive such as silicone oil, which are kneaded together.

However, with the aforesaid cleaning tape, dispersibility of the abrasive grains is low, and the abrasive grains often agglomerate and concentrate locally in the cleaning tape, thereby causing scratching of the polished surface. Also, in the case of the abrasive tape, since it is desired to contain harder abrasive grains having a higher Mohs hardness than the abrasive grains used in the cleaning tape, more scratching arises when the dispersibility of the abrasive grains is low. Thus a need exists for an abrasive tape which can achieve polishing without scratching the polished surface even though hard abrasive grains providing a high abrasion efficiency are used.

SUMMARY OF THE INVENTION

The primary object of the present invention is to provide an abrasive tape which achieves scratch-free finish-polishing of a rough-polished surface even though abrasive grains having a high Mohs hardness are used.

Another object of the present invention is to provide an abrasive tape which accurately and uniformly polishes a surface and improves the polishing efficiency.

The present invention provides an abrasive tape comprising a flexible non-magnetic substrate, and an abrasive coating film applied onto said flexible non-magnetic substrate and formed by kneading abrasive grains, a binder and an additive, wherein said binder contains a resin which has, at a side chain, at least one polar group selected from the group consisting of $$-SO_3M,\ -OSO_3M,\ -OSO_2M,\ -COOM,\ \text{and}\ -\underset{\underset{O}{\|}}{\overset{\overset{(OM_2)}{|}}{P}}-(OM_1)$$

where M represents a hydrogen atom, lithium, sodium, or potassium, $M_1$ represents a hydrogen atom, lithium, sodium, potassium, or an alkyl group, and $M_2$ represents a hydrogen atom, lithium, sodium, potassium, or an alkyl group.

In the general formula representing the polar group, the alkyl group which $M_1$ and/or $M_2$ may represent should preferably be a straight-chain saturated aliphatic hydrocarbon residue having one to 23 carbon atoms, or a branched-chain saturated aliphatic hydrocarbon residue having one to 23 carbon atoms. For example, the alkyl group may be a tricosyl group, a docosyl group, an eicosyl group, a nonadecyl group, an octadecyl group, a hexadecyl group, a tridecyl group, an undecyl group, a decyl group, a nonyl group, an octyl group, a hexyl group, a pentyl group, a butyl group, a t-butyl group, a propyl group, an isopropyl group, an ethyl group, or a methyl group. Also, $M_1$ and $M_2$ may be identical or different. Since the resin having the aforesaid polar group at the side chain exhibits excellent dispersibility, it is possible to obtain an abrasive coating film having the abrasive grains substantially evenly dispersed therein.

With the abrasive tape in accordance with the present invention, since the binder in the abrasive coating film contains at least one kind of the resin having the polar group at the side chain, dispersibility of the abrasive grains increases, and the abrasive grains are dispersed substantially without agglomerating locally. Therefore, it becomes possible to achieve polishing uniformly and accurately, and to prevent scratching of the surface. Also, since polishing can be conducted consistently, it becomes possible to use abrasive grains having a higher Mohs hardness and therefore exhibiting a higher polishing efficiency than in the conventional technique. As a result, the polishing rate becomes higher, and it becomes possible to shorten the polishing time and to improve the efficiency of the polishing operation.

BRIEF DESCRIPTION OF THE DRAWING

The single drawing is an enlarged sectional view showing an embodiment of the abrasive tape in accordance with the present invention being used for polishing a magnetic head.

DESCRIPTION OF THE PREFERRED EMBODIMENTS

The present invention will hereinbelow be described in further detail with reference to the accompanying drawing.

As shown in the drawing, an embodiment of the abrasive tape in accordance with the present invention comprises a flexible non-magnetic substrate 1, and an abrasive coating film 2 overlaid on the substrate 1. The abrasive coating film 2 is formed by kneading abrasive grains, a binder, and an additive including a lubricant or the like.

When the abrasive tape is used for polishing the tape sliding surface of a magnetic head 3, the abrasive tape is moved at a predetermined speed from one of two reels (not shown) disposed with the magnetic head 3 intervening therebetween to the other thereof. Thus the abrasive coating film 2 is made to slide on the magnetic head 3. At this time, the tape sliding surface of the magnetic head 3 is polished smoothly by hard abrasive grains protruding out of the surface of the abrasive coating film 2. The grain sizes of the abrasive grains may be adjusted in accordance with the purpose, and may be within the range of approximately 16μm to 1 μm for rough finishing, and within the range of approximately 1 μm to 0.1 μm for regular finishing.

The abrasive grains should preferably have a Mohs hardness of not lower than 6 and should preferably be harder than those used in conventional cleaning tapes. For example, the abrasive grains should preferably be formed of chromium oxide ($Cr_2O_3$) having a Mohs hardness of 8.5.

The abrasive grains are dispersed by kneading in the binder containing a polyester resin, a polyurethane resin, a vinyl chloride resin, or the like, wherein a polar group such as —$SO_3M$ has been introduced. The resins may be prepared by various methods. For example, the polyester resin may be prepared by using dicarboxylic acid component having a metal sulfonate group as a part of the dicarboxylic acid component as one of the starting materials for the polyester, and carrying out a condensation reaction of the dicarboxylic acid component containing the dicarboxylic acid component having a metal sulfonate group, carboxylic acid having no metal sulfonate group, and a diol. The polyurethane resin may be prepared by carrying out a condensation reaction and an addition reaction using the four kinds of starting materials for the polyester resin, and diisocyanate. Or, the polar group may be introduced into the resin by a dehydrochlorination reaction between the active hydrogen group contained in the polyester resin, the polyurethane resin, or the vinyl chloride resin and a compound containing chlorine, such as $Cl—CH_2CH_2SO_3M$, $Cl—CH_2CH_2OSO_2M$, $Cl—CH_2COOM$, or

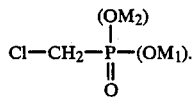

As the carboxylic acid component having no metal sulfonate group which may be used for obtaining the polyester resin, it is possible to use, for example, an aromatic dicarboxylic acid such as terephthalic acid, isophthalic acid, orthophthalic acid or 1,5-naphthalic acid; an aromatic oxycarboxylic acid such as p-oxybenzoic acid or p-(hydroxyethoxy)benzoic acid; an aliphatic dicarboxylic acid such as succinic acid, adipic acid, azelaic acid, sebacic acid or dodecane dicarboxylic acid; a tricarboxylic acid or a tetracarboxylic acid such as trimellitic acid, trimesic acid or pyromellitic acid. Among the above enumerated carboxylic acid components, terephthalic acid, isophthalic acid, adipic acid and sebacic acid are particularly preferable. Also as the dicarboxylic acid component having the metal sulfonate group, it is possible to use, for example, 5-sodium sulfoisophthalate, 5-potassium sulfoisophthalate, 2-sodium sulfoterephthalate, or 2-potassium sulfoterephthalate.

As the diol component which may be used for obtaining the polyester resin, it is possible to use, for example, ethylene glycol, propylene glycol, 1,3-propanediol, 1,4-butanediol, 1,5-pentanediol, 1,6-hexanediol, neopentyl glycol, diethylene glycol, dipropylene glycol, 2,2,4-trimethyl-1,3-pentanediol, 1,4-cyclohexane dimethanol, an addition product of bisphenol A with ethylene oxide, an addition product of hydrogenated bisphenol A with ethylene oxide, an addition product of hydrogenated bisphenol A with propylene oxide, polyethylene glycol, polypropylene glycol, or polytetramethylene glycol. A triol or a tetraol such as trimethylolethane, trimethylolpropane, glycerin or pentaerythritol may also be used in combination with the aforesaid diol component.

As the isocyanate component which may be used for obtaining the polyurethane resin, it is possible to use, for example, 2,4-tolylene diisocyanate, 2,6-tolylene diisocyanate, p-phenylene diisocyanate, diphenylmethane diisocyanate, m-phenylene diisocyanate, hexamethylene diisocyanate, tetramethylene diisocyanate, 3,3'-dimethoxy-4,4'-biphenylene diisocyanate, 2,4-naphthalene diisocyanate, 3,3'-dimethyl4,4'-biphenylene diisocyanate, 4,4'-diphenylene diisocyanate, 4,4'-diisocyanatediphenyl ether, 1,3-naphthalene diisocyanate, p-xylylene diisocyanate, m-xylylene diisocyanate, 1,3-diisocyanate methylcyclohexane, 1,4-diisocyanate methylcyclohexane, 4,4'-diisocyanate dicyclohexylmethane, or isophorone diisocyanate.

As the vinyl chloride resin which is to be modified for introduction of the metal sulfonate group, it is possible to use vinyl chloride-vinyl acetate-vinyl alcohol copolymer, vinyl chloride-vinyl propionate-vinyl alcohol copolymer, vinyl chloride-vinyl acetate-vinyl maleate-vinyl alcohol copolymer, vinyl chloride-vinyl propionate-vinyl maleate-vinyl alcohol copolymer, or the like. In this case, the —OH group of the vinyl alcohol contained in the vinyl chloride resin may be reacted with the metal sulfonate containing chloride, such as $Cl—CH_2CH_2SO_3M$ or $Cl—SO_3M$, in the presence of a dehydrochlorination agent, e.g. an amine such as pyridine, picoline or triethylamine, ethylene oxide, or propylene oxide in an organic polar solvent such as dimethylformamide or dimethyl sulfoxide.

In the present invention, the resin having the polar group should preferably be contained in the binder in a radio of not lower than 30% by weight with respect to the total amount of the binder components. When the ratio of the amount of the resin is lower than 30% by weight, a substantial dispersion effect cannot be obtained. The molecular weight of the resin having the polar group should not be higher than 50,000.

Also, the molecular weight of the aforesaid resin should preferably be not lower than 2,000. This is because unreacted components remain in the course of curing the polar coating composition overlaid on the substrate by use of a curing agent when the molecular weight is lower than 2,000, and the physical property of the abrasive coating film is deteriorated when low-molecular weight components remain in the abrasive coating film. The molecular weight of the resin having the polar group should more preferably be not lower than 10,000. Accordingly, the more preferable range of the molecular weight of the resin is from 10,000 to 50,000. Also, the polar group should preferably be contained in the resin in such a ratio that the molecular weight per polar group is in the range of 2,000 to 50,000. When the molecular weight per polar group is higher than 50,000, no substantial improvement in dispersibility can be expected. When it is lower than 2,000, solubility in the non-polar solvent becomes low.

The abrasive coating film may be added with an additive such as a lubricant for improving the movement stability of the abrasive tape, as in the case of the conventional cleaning tape. The flexible non-magnetic substrate 1 may be formed of polyethylene terephthalate (PET), polyethylene-2,6-naphthalate or the like.

The thickness of the abrasive coating film 2 should preferably be not larger than 50 μm, the actual thickness depending on the shape and material of the magnetic head 3. When the thickness of the abrasive coating film 2 is too thick, the contacting condition of the abrasive tape with the magnetic head 3 is deteriorated.

The present invention will further be illustrated by the following non-limitative examples.

EXAMPLE 1

An abrasive tape was made by applying a coating composition as shown below to a thickness of 5 μm onto a 12 μm-thick polyethylene terephthalate (PET) substrate. The parts in the following descriptions are parts by weight (weight of solid contents).

Coating composition:

| | |
|---|---|
| $Cr_2O_3$ (granular, size: 0.3μ, Mohs hardness: 8.5) | 300 parts |
| Vinyl chloride-vinyl acetate copolymer (copolymerization ratio: 87:13, Polymerization degree: 350) | 34.7 parts |
| Sulfonate group-containing polyurethane resin (molecular weight: 25,000, molecular weight per —$SO_3H$: 25,000) | 21 parts |
| Soybean lecithin | 2.4 parts |
| Silicone oil (dimethyl polysiloxane) | 0.1 part |
| Polyisocyanate (75 wt % ethyl acetate solution of a reaction product of 3 mols of 2,4-tolylene diisocyanate compound with 1 mol of trimethylolpropane) | 18 parts |
| Methyl ethyl ketone | 400 parts |
| Toluene | 400 parts |

EXAMPLE 2

An abrasive tape was made in the same manner as Example 1, except that a different resin was used instead of the sulfonate group-containing polyurethane resin.

Coating composition:

| | |
|---|---|
| $Cr_2O_3$ (granular, size: 0.3μ, Mohs hardness: 8.5) | 300 parts |
| Vinyl chloride-vinyl acetate copolymer (copolymerization ratio: 87:13, polymerization degree: 350) | 34.7 parts |
| Carboxyl group-containing polyurethane resin (molecular weight: 10,000, molecular weight per —COOH: 10,000) | 2.4 parts |
| Soybean lecithin | 0.1 part |
| Silicone oil (dimethyl polysiloxane) | 0.1 part |
| Polyisocyanate (75 wt % ethyl acetate solution of a reaction product of 3 mols of 2,4-tolylene diisocyanate compound with 1 mol of trimethylolpropane) | 18 parts |
| Methyl ethyl ketone | 400 parts |
| Toluene | 400 parts |

COMPARATIVE EXAMPLE 1

As a Comparative example, an abrasive tape was made by applying the coating composition as shown below onto a substrate approximately similar to that used in the Example 1. The sample obtained by the Comparative Example 1 is the same as Sample No. 24 disclosed in Japanese Unexamined Patent Publication No. 53(1978)-102017.

Coating composition:

| | |
|---|---|
| ZnO (size: 120 μm diameter, Mohs hardness: 4.5) | 300 parts |
| Vinyl chloride-vinyl acetate copolymer (copolymerization ratio: 87:13, polymerization degree: 350) | 34.7 parts |
| Polyester polyol (reaction product of 1 mol of adipic acid, 1 mol of diethylene glycol, with 0.06 mol of trimethylolpropane; viscosity at 75° C.: 1,000CP, specific gravity: 1.18, OH value: 60, acid value: <2) | 21 parts |
| Soybean lecithin | 2.4 parts |
| Silicone oil (dimethyl polysiloxane) | 0.1 part |
| Polyisocyanate (75 wt % ethyl acetate solution of a reaction product of 3 mols of 2,4-tolylene diisocyanate compound with 1 mol of trimethylolpropane) | 18 parts |
| Methyl ethyl ketone | 400 parts |
| Toluene | 400 parts |

For the abrasive tapes of Example 1, Example 2 and Comparative Example 1, the head polishing time and generation of scratches on the head surface after polishing were investigated. The results were as shown in Table 1.

TABLE 1

| | Head polishing time | Scratches on head surface | Remarks |
|---|---|---|---|
| Example 1 | 3.0 sec. | Four | Good |
| Example 2 | 3.2 sec. | Two | Good |
| Comparative Example 1 | 5 min. | Many | Bad for both polishing time and scratching |

In Table 1, the head polishing time was the time required for polishing the ferrite head by 1 μm. As for the scratches on the head surface, scratches having a width of not smaller than 2 μm were investigated by observing the gap surface of the magnetic head by use of a microscope after the polishing.

As clear from Table 1, since dispersibility in the binder is improved and the abrasive grains having a Mohs hardness higher than in the conventional technique are usable in Example 1 and Example 2 in accordance with the present invention, the abrasive tapes of Example 1 and Example 2 markedly shorten the polishing time, achieve a high polishing efficiency, and markedly minimize scratching of the magnetic head surface even though the abrasive tapes contain the hard abrasive grains.

We claim:

1. An abrasive tape comprising a flexible non-magnetic substrate, and an abrasive coating film having a thickness of not greater than 50 μm applied onto said flexible non-magnetic substrate and formed by kneading abrasive grains having a size in the range of from approximately 0.1 μm to 16 μm and having a Mohs hardness of not lower than 6, a binder and an additive, wherein said binder contains a resin in a ratio of not lower than 30% by weight with respect to the total amount of the binder components, has a molecular weight of not higher than 50,000 and has, at a side chain, at least one polar group selected from the group consisting of $$-SO_3M,\ -OSO_3M,\ -OSO_2M,\ -COOM,\ \text{and}\ -\underset{\underset{O}{\|}}{\overset{\overset{(OM_2)}{|}}{P}}-(OM_1)$$

where M represents a hydrogen atom, lithium, sodium or potassium, $M_1$ represents a hydrogen atom, lithium, sodium, potassium, or an alkyl group, and $M_2$ represents a hydrogen atom, lithium, sodium, potassium, or an alkyl group, and wherein the total amount of the binder components, including a curing agent if present, is not greater than 70 parts by weight per 300 parts by weight of the abrasive grains having a Mohs hardness of not lower than 6.

2. An abrasive tape as defined in claim 1 wherein the alkyl group represented by $M_1$ is selected from the group consisting of a straight-chain saturated aliphatic hydrocarbon residue having one to 23 carbon atoms, and a branched-chain saturated aliphatic hydrocarbon residue having one to 23 carbon atoms.

3. An abrasive tape as defined in claim 1 wherein the alkyl group represented by $M_2$ is selected from the group consisting of a straight-chain saturated aliphatic hydrocarbon residue having one to 23 carbon atoms, and a branched-chain saturated aliphatic hydrocarbon residue having one to 23 carbon atoms.

4. An abrasive tape as defined in claim 1 wherein said resin has a molecular weight within a range of 2,000 to 50,000.

5. An abrasive tape as defined in claim 4 wherein said resin has a molecular weight within a range of 10,000 to 50,000.

6. An abrasive tape as defined in claim 1 wherein said polar group is contained in said resin in such a ratio that the molecular weight per polar group is in the range of 2,000 to 50,000.

* * * * *